United States Patent [19]

Brown

[11] Patent Number: 4,641,756

[45] Date of Patent: Feb. 10, 1987

[54] UNITARY PANTS HOLDER

[76] Inventor: Robert L. Brown, 322 Davis Dr., Kingston, Tenn. 37763

[21] Appl. No.: 759,648

[22] Filed: Jul. 26, 1985

[51] Int. Cl.[4] ..... A47F 5/08

[52] U.S. Cl. ..... 211/89; 223/96

[58] Field of Search ..... 211/89, 88, 113, 45, 211/6; 248/316.2, 314; 223/96, 91, 95

[56] References Cited

U.S. PATENT DOCUMENTS

| | | | |
|---|---|---|---|
| 1,697,711 | 1/1929 | Brown | 211/88 |
| 2,279,237 | 4/1942 | Kellems et al. | 211/66 X |
| 3,063,569 | 11/1962 | Huber | 211/89 |
| 3,361,267 | 1/1968 | Burkholder | 211/89 |
| 3,377,041 | 4/1981 | Grant | 211/6 X |
| 3,762,570 | 10/1973 | Tobin | 211/113 X |
| 3,893,570 | 7/1975 | Vogt | 211/89 |
| 4,454,969 | 6/1984 | Huth | 223/96 |

FOREIGN PATENT DOCUMENTS

| | | | |
|---|---|---|---|
| 1466737 | 12/1966 | France | 211/89 |

*Primary Examiner*—Robert W. Gibson, Jr.
*Attorney, Agent, or Firm*—Pitts and Brittian

[57] ABSTRACT

A holder for pants and like garments for mounting on a vertical surface. This holder (10) is unitary in construction, and is formed with a back panel (12) having apertures (18) for receiving fastening means therethrough for mounting purposes. Attached proximate the top edge of the back panel is an open body member (20) that is substantially co-extensive with the back panel. This body member is generally C-shaped in cross-section, and is typically formed from a top panel (22), a front panel (24), and a lower lip member (26) which extends back toward the back panel. This lip terminates a selected distance from the back panel to form a garment-receiving slot (28). The entrances to the slot are enhanced by providing rounded corners (30) at both ends of the lip. By this construction, a garment can be slid into the slot from either end and be supported in an upright manner in the holder. The body has sufficient space within whereby even pants with a belt unremoved can be stored. The flexibility of the C-shaped body permits the storage of garments of various thickness, and this is useful for pants, skirts and other like garments. Several embodiments are described to illustrate various means of fabrication of the holder of the present invention. In a preferred embodiment, the holder is provided with a tray on the top thereof for holding miscellaneous accessories such as rings, pins, etc.

12 Claims, 6 Drawing Figures

UNITARY PANTS HOLDER

1. Technical Field

This invention relates generally to hangers or holders for garments of the type referred to as pants, slacks and like garments having a top band portion of additional thickness, and more particularly to a unitary holder for mounting on a vertical surface for the frictional holding of the garment in an upright position from that top band portion.

2. Background Art

A large number of hanger-type devices have been utilized for the support of pants, slacks, skirts and other similar garments when the garments are not in use. Probably the most common of these hangers is the type having a pair of parallel members that are moved toward each other by a camming lever to cause the members to frictionally grasp the exterior surfaces of the garment. In the case of pants, these members grasp the two cuff regions causing the two cuffs to be pressed together while the pants are hung in an inverted position. The current style of pants, however, does not utilize a turned-over cuff and therefore there is less material to be grasped. Accordingly, this "presser" type holder or hanger is less effective.

Other hangers have been developed to be used for hanging pants from the cuff region. One is shown in U.S. Pat. No. 2,562,559 issued to E. A. Lyman on July 31, 1951. That device provides for insert members to catch in the turned-over cuffs. Another is shown in U.S. Pat. No. 960,549 issued to M. A. Hoffman on June 7, 1910. This hanger is mounted on the under side of a closet shelf and the mounting bracket is slidable from a storage position to an extended position for ease of use. It utilizes a pair of fingers, the distance between the fingers being adjustable such that the fingers engage the inside of the pant legs at the cuff region. This device is usable for pants without turned-over cuffs.

Some of the hangers that have been developed provide for the hanging of the pants in an upright position; i.e., with the band region at the top. Two patents which describe devices that utilize engagement with the belt loops are U.S. Pat. No. 2,288,551 issued to R. J. Shanahan on June 30, 1942, and 2,513,535 issued to E. G. Von Gunten on July 4, 1950. In most cases any belt that is used for the pants must be removed before these hangers can be used. The advantage of hanging in this orientation is the freedom from emptying the pockets prior to hanging of the pants. Some pants and similar garments, however, do not have belt loops so that these devices will be of no value for such garments. Another device for the upright hanging of pants that does not utilize the belt loops is shown in U.S. Pat. No. 4,196,813 issued to M. Cohen on Apr. 8, 1980. This is similar to the aforementioned '549 patent in that fingers grasp the inside of the waist band (instead of the inside of the cuff); however, any garment fly/placket must be closed.

Of course there are many devices that hold pants and similar garments in a folded orientation over some type of rod or bar. Typical of some patented versions of such holders are those shown in U.S. Pat. No. 2,287,473 issued to W. H. Glines on June 23, 1942 and U.S. Pat. No. Des. 111,666 issued to W. L. Sevey on Oct. 11, 1933 and U.S. Pat. No. Des. 190,402 issued to E. S. Welch on May 23, 1961. All three of these devices are intended to be supported from a conventional closet rod.

A review of the above-cited references will reveal that not one of these devices will satisfactorily hold all types of men's pants in an upright orientation. Furthermore, those devices require the removal of a belt (if such is used) from the loops before engaging the pants (except for the '813 patent). In addition, if these devices are sized for the hanging of men's garments, they will not be suitable for women's garments; e.g. skirts. Several of the devices have rather complex structures and are thus expensive to construct. When the hangers are used that require placement upon the closet rod, several steps are required and this often deters a person from properly hanging the pants, they are often just draped over a chair.

Accordingly, it is a principal object of the present invention to provide a hanger or holder for pants and similar garments that can be securely mounted upon a vertical surface and which will support the garments in an upright position with little effort.

It is another object to provide a holder for pants and similar garments that is unitary in construction and is readily fabricated.

It is also another object of the present invention to provide a holder for pants and similar garments that does not necessitate the removal of a belt from the garments or the removal of the contents of the pockets before hanging the garments in the holder.

A further object of the present invention is to provide a holder for pants and similar garments that can be used for various sizes and constructions of either men's or women's garments.

These and other objects of the present invention will become apparent upon a consideration of the drawings referred to hereinafter, and the detailed description of the invention.

SUMMARY OF THE INVENTION

In accordance with the present invention there is provided a unitary holder for pants and similar garments having a back panel for attachment to a substantially vertical surface such as a wall or a closet door. Projecting from this back panel, and attached thereto, is an open body member having a generally C-shaped cross-section. The lower portion of the body member is spaced from the back panel a selected distance to thereby define a lengthwise slot for the insertion of the garment. Preferably, the edges of the body at both entrances to this slot are rounded to facilitate entry of the garment into the slot from either end. In a preferred embodiment, the body member is provided with a tray for the storage of accessory elements, such as watches, identification badges and the like.

DETAILED DESCRIPTION OF THE INVENTION

Figure 1:
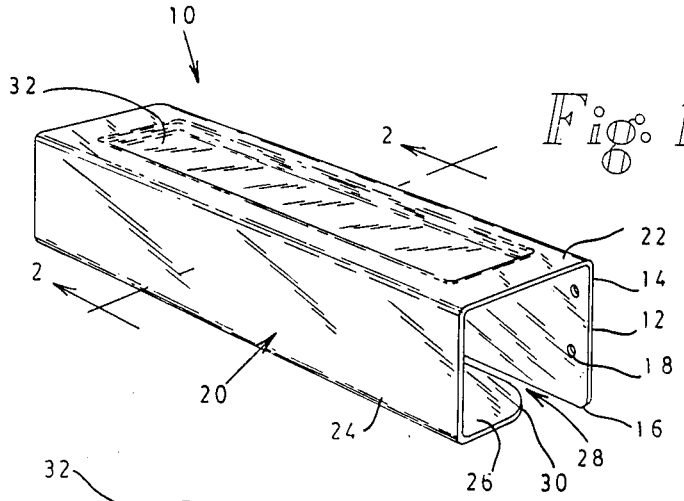
FIG. 1 is an isometric drawing of a holder according to the present invention as manufactured from a single sheet of material.

One of several embodiments of the present invention is shown at 10 of FIG. 1. This embodiment is amendable to fabrication from a single sheet of material, such as plastic. This holder has a rectangular back panel 12, with a top edge 14 and a bottom edge 16, which is provided with a plurality of apertures 18 to accept fastening means (not shown) for fastening the holder to a vertical surface such as a wall or a closet door. Extending from the back panel at the top edge 14, is a hollow body member 20 that is substantially co-extensive in length with the back panel. This body member 20 is substantially C-shaped in cross-section, and is formed with a top panel 22, a front panel 24, and a bottom lip 26 directed toward the back panel. As shown, this bottom lip 26 terminates a selected distance from the back panel 12 and thereby forms a slot 28 the entire length of the holder 10. The lip 26, at both ends, is provided with a rounded corner 30 to facilitate movement of garments into and out of the slot 28. In this embodiment, the top panel 22 of the body member 20 is provided with a substantially rectangular depression or recess 32. This forms a tray for the storage of miscellaneous items, such as watches, rings, etc.

Figure 2:
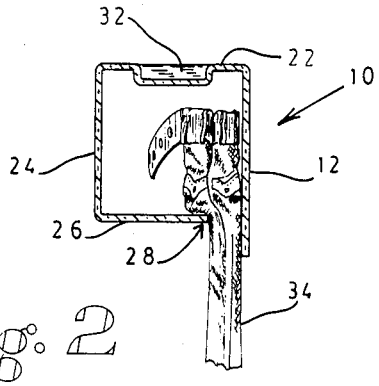
FIG. 2 is a cross-sectional view of the holder of FIG. 1 taken at 2—2 thereof.

A cross-sectional view of the embodiment of FIG. 1 is shown in FIG. 2. In this view it is shown how a garment 34, such as a pair of pants, is frictionally held in the slot 28 between the edge of the lip 26 and the back panel 12. There is sufficient space within the body member 20 to accomodate even a belt on the pants 34. The slight flexibility of the body 20, because of the singular point of attachment to the back panel 12, will permit some variation of thickness of the garment 34 in the slot 28.

Typically, this embodiment is fabricated from an acrylic plastic sheet formed in a suitable manner into the form as shown. Dimensions of the holder are not critical to its operation except that the slot size is selected to accept and hold the garment, and the body has sufficient size to accept the garment. An example of size, however, is given to provide a better understanding of the invention. Typically, the holder has a length of about sixteen inches, and the back panel has a height of four inches. The body member projects about three inches from the back panel, and the slot has a width of about three-eights of an inch. The rounded edges of the lower lip at the entrances to the slot have typically a radius of about 1.5 in. The tray is typically three-fourths inch deep, has a length of about fourteen inches and a width of about two inches. When fabricated from a sheet of plastic, the thickness of the sheet is typically 0.1 in.

Figure 4:
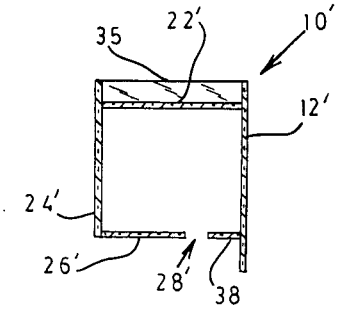
FIG. 4 is a cross-sectional drawing of the holder of FIG. 3 taken at 4—4 thereof.
Figure 3:
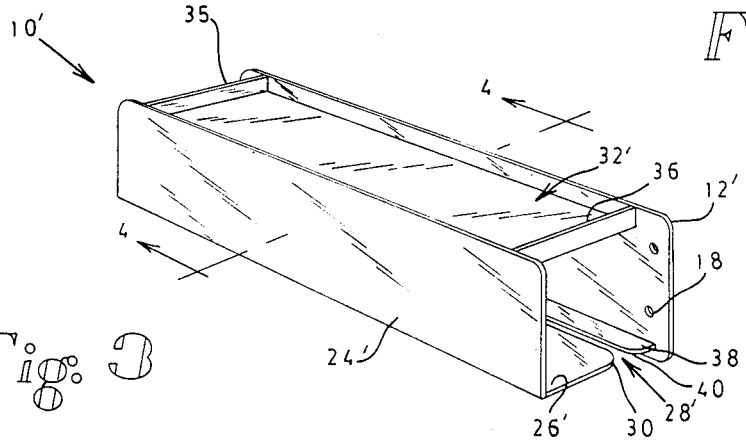
FIG. 3 is an isometric drawing of another embodiment of the present invention as manufactured from numerous flat sheets of material, with these sheets appropriately bonded to form a unitary structure.

Another embodiment of the present invention is illustrated at 10' in the isometric drawing of FIG. 3 and the cross-section of FIG. 4. This embodiment functions in the same manner as the embodiment of FIG. 1 and 2; however, instead of being fabricated from a single sheet of material, it is fabricated from a plurality of flat pieces appropriately joined. Each component that is substantially the same as in the above-described embodiment carries the same identification number but with a prime. Items that are identical do not have a prime on the number. There is a back panel 12', which is provided with apertures 18 for mounting means, that provides for securing the holder upon any suitable vertical surface. The open C-shaped body member 20' is made up of a top panel 22', a front panel 24' and a lip 26', with each of these joined to each other by any suitable means. In addition, the tray 32' is formed by adding two end walls 35, 36 such that a portion of the back panel 12', the top panel 22' and a portion of the front panel 24' form the rest of the tray.

This embodiment of FIGS. 3–4 shows a further variation in the formation of the garment-receiving slot 28'. There is a second lip 38 that projects from the back panel 12' and is aligned with the lip 26'. It also has rounded ends as at 40 to facilitate entry of the garment into the slot. This construction may be of particular value if garments to be entered into the holder are particularly bulky at the extreme top. For most applications, however, the single lip supported from the front panel is preferred because of the simplicity of fabrication.

Figure 5:
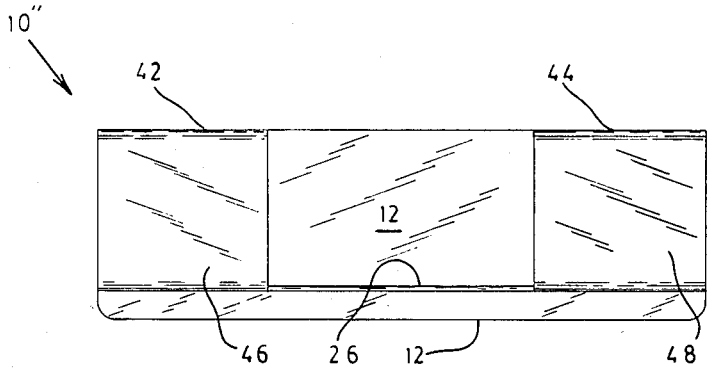
FIG. 5 is a frontal view of another embodiment of the present invention.

Still another embodiment of the present invention is illustrated at 10'' in FIG. 5. This particular embodiment is shown as being without a top tray; however, such can be added if desired. The other variation from the embodiment of FIG. 1 is that the top panel is not continuous from end to end, but is divided into two portions 42, 44, also, the front panel is made of two portions 46, 48. These top and front panel portions are substantially co-extensive and support the rearwardly directed lip 26. Because of the space between the portions 46, 48, the back panel 12 can be see in this frontal view. If a tray is used, it can span the two top panel portions 42, 44 or depressions or recesses can be formed in these two top panel portions.

Figure 6:
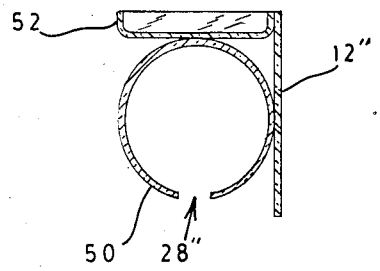
FIG. 6 is a cross-sectional view of an embodiment of the present invention wherein the body member is an open cylinder, with a wall portion removed to provide the slot for insertion of garments.

Having shown and described several constructions of holders that are within the scope of the invention, persons skilled in the art will be able to design other embodiments that perform the same function in the same way. Many such designs will utilize material that have already been preformed. An illustration of such a variation is that show in FIG. 6. This embodiment utilizes a preformed cylindrical pipe 50 to create the open body. A wall portion is cut axially from the cylinder to produce the slot 28''. This body is attached to a back panel 12'' in any suitable manner. For some applications, a portion of the cylinder itself can serve as the back panel. Furthermore, a prefabricated tray 52 can be added to the top of the body and be attached thereto. If desired, the tray can be also attached to the back panel to further strengthen the holder.

Both men and women often like to wear their pants, slacks and skirts more than once before laundering or dry cleaning. The holder described herein provides a simple and quick way of storing these garments between wearings. The garment is slipped into the slot of the holder immediately after being taken off so that it is neatly hung until the next wearing. Nothing must be removed from the pockets, no mechanism must be operated to hold the garment in place, and even a belt of a wearer need not be removed prior to use of the holder. When the garments are stored in this orientation, wrinkles "hang out" during the interval between wearings thereby keeping the garments looking their best. The open end at each end of the holder makes use thereof simplified for any location of the holders on walls, doors, etc.

Various embodiments of the present invention have been shown and described herein. While the holder has been described as for use with garments, other compressible items can be held thereby, such as towels, etc. It is not intended to limit the invention by these embodiments, rather the invention is to be defined by the appended claims and their equivalents.

I claim:

1. A unitary holder for pants and like garments, such holder adapted for mounting upon a substantially vertical surface, which comprises:

a substantially rectangular back panel having a top edge and a bottom edge, said back panel being provided with apertures therethrough for passage of fastening means for mounting such holder upon such surface; and a hollow body member having open ends, said body member being substantially co-extensive with said back panel and substantially C-shaped in cross-section having a top edge and a bottom lip, said top edge of said body member joined to said back panel, said bottom lip of said body member terminating in an edge at a selected distance from said back panel to define a continuous slot between said edge of said lip and said back panel to slidably accept such garments from either end of said body, said body member having sufficient flexibility whereby said slot will accept garments of different thicknesses, and said lip will frictionally hold such garments against said back panel.

2. The holder of claim 1 further comprising a tray member located proximate and joined to said top edge of said body member.

3. The holder of claim 1 wherein said C-shaped body member comprises:

a substantially rectangular top panel substantially perpendicular to said body member having a rear edge joined to said top edge of said back panel, and a front edge;

a substantially rectangular front panel substantially perpendicular to said top panel having a top edge joined to said front edge of said top panel, and a bottom edge; and a substantially rectangular lip member substantially perpendicular to said front panel having a front edge joined to said bottom edge of said front panel, and a rear edge directed toward said back panel terminating said selected distance from said back panel to form said slot, said rear edge of said lip being provided with rounded end portions to facilitate entrance of such garment into said slot.

4. The holder of claim 3 wherein said back panel, said top panel, said front panel and said lip member are fabricated from a single sheet of material.

5. The holder of claim 4 wherein said top member is provided with a substantially rectangular recess to form a tray.

6. The holder of claim 4 wherein said material is an acrylic plastic.

7. The holder of claim 3 wherein said back panel, said top panel, said front panel and said lip member are fabricated from individual flat sheets of material and joined to form such holder.

8. The holder of claim 1 wherein said C-shaped body member is formed from a cylindrical pipe, said pipe having an axially oriented wall portion removed to form said slot.

9. The holder of claim 8 further comprising a tray member extending axially along and attached to said cylindrical pipe, said tray member disposed on a side of said pipe substantially diametrically opposite said slot.

10. The holder of claim 1 further comprising a second lip member, said second lip member joined to and extending along said back panel and aligned with said lip member of said body member, said second lip member terminating from said lip member of said body member to define said slot, said second lip member being provided with rounded end portions at said slot.

11. The holder of claim 3 wherein said top panel is divided into two substantially equal spaced-apart portions and said front panel is divided into two substantially equal spaced-apart portions substantially co-extensive with said portions of said top panel.

12. A unitary holder for pants and like garments, such holder fabricated from a single sheet of material, adapted for mounting upon a substantially vertical surface, which comprises:

a substantially rectangular back panel having a top edge and a bottom edge, said back panel being provided with apertures therethrough for passage of fastening means for mounting such holder to such surface;

a substantially rectangular top panel substantially perpendicular to and co-extensive with said back panel, said top panel having a rear edge integrally joined to said top edge of said back panel, and a front edge, said top panel being provided with a substantially rectangular recess to form a storage tray;

a substantially rectangular front panel substantially perpendicular to and co-extensive with said top panel, said front panel having a top edge integrally joined to said front edge of said top panel, and a bottom edge; and a substantially rectangular lip member substantially perpendicular to and co-extensive with said front panel, said lip member having a front edge integrally joined to said bottom edge of said front panel, and a rear edge directed toward said back panel, said rear edge spaced from said back panel a selected distance to define a continuous slot between said rear edge of said lip member and said back panel to slidably accept such garments from either end of such holder;

wherein said top panel and said front panel have sufficient mutual flexibility whereby said slot will accept garments of different thicknesses, and said lip will frictionally hold such garments against said back panel.

* * * * *